US006141871A

United States Patent [19]

Okada

[11] Patent Number: 6,141,871

[45] **Date of Patent: *Nov. 7, 2000**

[54] ELECTRICAL CONNECTION BOX AND A METHOD FOR FORMING TERMINALS

[75] Inventor: Kouichi Okada, Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/120,065

[22] Filed: Jul. 21, 1998

[30] Foreign Application Priority Data

Jul. 29, 1997 [JP] Japan ..... 9-203510

[51] Int. Cl.[7] ..... H01R 43/16

[52] U.S. Cl. ..... 29/874; 29/825; 29/622

[58] Field of Search ..... 29/874, 623, 825, 29/622; 439/621, 622; 337/187, 186; 200/275, 279

[56] References Cited

U.S. PATENT DOCUMENTS

| | | | |
|---|---|---|---|
| 4,601,531 | 7/1986 | Wider | 339/272 |
| 5,662,496 | 9/1997 | Kanamori et al. | 439/621 |

FOREIGN PATENT DOCUMENTS

| | | | |
|---|---|---|---|
| 004342269 | 6/1994 | Germany | 29/874 |
| 43 42 269 | 6/1994 | Germany . | |
| 4-09579 | 4/1992 | Japan . | |
| 5-33469 | 4/1993 | Japan . | |
| 406176847 | 6/1994 | Japan | 29/874 |
| 9-34752 | 5/1997 | Japan . | |

*Primary Examiner*—Lee Young
*Assistant Examiner*—Sean P. Smith
*Attorney, Agent, or Firm*—Anthony J. Casella; Gerald E. Hespos; Michael J. Porco

[57] ABSTRACT

Busbars to be connected with a pair of terminals of a fuse are formed from one conductive plate and thus can be arranged in the same layer in an electrical connection box. First and second busbars 13, 14 to be connected with a pair of terminals 11, 12 of a fuse 10 have coplanar base plates 13*a*, 14*a*. Bent portions 13*b*, 14*b* are provided at the leading ends of the respective base plates 13*a*, 14*a* and also are coplanar. Distant side edges of the bent portions 13*b*, 14*b* are provided with folded portions 13*c*, 14*c* which are parallel with each other and with the side surfaces of the base plates 13*a*, 14*a*. Slits 13*d*, 14*d* are formed by making cuts from the upper ends of the opposite folded portions 13*c*, 14*c*, so that the pair of terminals 11, 12 of the fuse 10 can be pressed into the slits 13*d* 14*d* to connect the fuse electrically with the busbars. The first and second busbars 13, 14 are formed by punching one conductive plate and are arranged in the same layer inside a casing. Furthermore the invention relates to a method for forming a terminal of connection busbars.

7 Claims, 4 Drawing Sheets

ELECTRICAL CONNECTION BOX AND A METHOD FOR FORMING TERMINALS

BACKGROUND OF THE INVENTION

1. Field of the Invention

The present invention relates to an electrical connection box connectable with an automotive wiring harness and is designed particularly to connect busbars accommodated in the electrical connection box and a terminal of a fuse mounted in the electrical connection box. The present invention furthermore relates to a method for forming terminals on connecting busbars for such an electrical connection box.

2. Description of the Prior Art

Prior art busbars are accommodated in a prior art electrical connection box substantially as shown in FIG. 4. More particularly, prior art busbars 2, 3 are connectable respectively with terminals 1*a*, 1*b* of a prior art fuse 1. The prior art busbars 2, 3 are provided at their opposite leading ends with cramping connection portions 2*a*, 3*a*, which are formed by bending the leading ends of the busbars 2, 3 at right angles to remaining portions of the busbars. The bent leading ends then are folded back approximately 180° about fold lines that are parallel to the bend line. Slits 2*b*, 3*b* then are cut into the fold line of the cramping connection portion 2*a*, 3*a* and portions of the cramping connection portions 2*a*, 3*a* of the busbars 2, 3 on opposite sides of the fold line. The terminals 1*a*, 1*b* of the fuse 1 then are pressed into slits 2*b*, 3*b*.

The cramping connection portions 2*a*, 3*a* of the busbars 2, 3 are long in their developed states. The sum of the lengths of the cramping connection portions 2*a*, 3*a* in their developed states is larger than a spacing between the terminals 1*a*, 1*b*. Accordingly, in case one would like to form the connection portions 2*a* and 3*a* from one conductive plate 5 (e.g. by cutting and bending steps) they would interfere each other by overlapping. Therefore, the prior art busbars 2, 3 cannot be made from one conductive plate 5.

Since a pair of busbars to be connected with one fuse cannot be formed from one conductive plate 5, the pair cannot be formed by progressive molds, or in a continuous working line. Accordingly, the busbars need to be mounted separately later in the electrical connection box. This causes problems of more labor and time to assemble and a poor yield of the conductive plate.

Alternatively, the busbars 2, 3 to be connected with the terminals 1*a*, 1*b* of one fuse 1 need to be arranged in different layers in a casing of the electrical connection box as shown in FIG. 6. This makes a circuit design inside the casing complicated, making a high density arrangement impossible.

In view of the above problems, an object of the present invention is to form busbars having terminals or press connection portions to be connected with terminals of a fuse from one conductive plate.

SUMMARY OF THE INVENTION

According to the invention, there is provided an electrical connection box for connecting busbars accommodated in a casing with at least one pair of terminals of at least one fuse to be fitted into a fuse receptacle of the casing. The busbars each comprise a base plate. At least one bent portion is provided at a leading end of the base plate. The bent portion is arranged at an angle different from 0° or 180° with respect to the base plate. At least one folded portion is provided at a side edge of each bent portion most distant from the bent portion of the other busbar. Slits are formed in the folded portions for the connection with the terminals of the fuse.

According to a preferred embodiment of the invention, the bent portion is arranged substantially normal with respect to the base plate.

Preferably, the base plates are arranged substantially in parallel with each other, and the folded portion further preferably extends substantially in parallel with the respective side surface of the base plate.

Further preferably, the slits are or comprise cuts formed from the upper ends of the substantially opposite folded portions, the pair of terminals of the fuse being pressed or pressable into the slits for electrical connection with the busbars.

Most preferably, the base plates are substantially horizontally extending base plates and/or the bent portions are substantially vertically extending bent portions.

According to a further preferred embodiment of the invention, there is provided an electrical connection box for connecting busbars accommodated in a casing with a pair of terminals of a fuse to be fitted into a fuse receptacle formed on the outer surface of the casing, wherein first and second busbars are connectable with the pair of terminals of the fuse and comprise horizontally extending base plates arranged in parallel with each other. Vertically extending bent portions are provided at the leading ends of the respective base plates. Folded portions are provided at the distant side edges of the bent portions and extend parallel with the side surfaces of the base plates. Slits are formed by making cuts from the upper ends of the oppositely folded portions. The pair of terminals of the fuse can pressed into the slits for electrical connection with the busbars.

As described above, the base plates of the first and second busbars are not opposed to each other, but arranged substantially in parallel, and the folded portions are provided at the distant side edges of the bent portions which extend substantially vertically from the leading ends of these busbars. Accordingly, these folded portions are opposed to each other in a direction normal to the arrangement direction or extension of the base plates. Thus, by forming the slits from the upper ends of the folded portions opposed to each other by a specified distance, the pair of terminals of the fuse can be pressed thereinto to establish an electrical connection between the fuse and the busbars.

Preferably, first and second busbars are formed by punching one conductive plate and are arranged in the same layer in the casing.

As described above, the first and second busbars are not substantially opposed to each other, but are arranged substantially parallel, and the bent portions and the folded portions are provided at the leading ends of the busbars by being bent in opposite directions. Accordingly, a pair of busbars to be connected with a pair of fuses can be formed from one conductive plate. Thus, these busbars can be formed by a progressive mold and can be arranged in the same layer without being mounted in the casing of the electrical connection box later.

According to the invention, there is further provided a method for forming terminals or (press) connection portions on busbars for an electrical connection box, for connecting the busbars accommodated in a casing and at least one pair of terminals of at least one fuse. The method comprises the first step of punching a conductive plate for forming at least a pair of busbars each having a base plate. The method continues by bending the busbars along first bending lines for arranging bent portions at an angle different from 0° or 180° with respect to the base plates at leading ends thereof, and folding or bending the busbars along second bending lines for arranging folded portions at an angle different from 0° or 180° with respect to the bent portions at distant edges thereof. The method then includes forming slits in the folded portions for the connection with the terminals of the fuse.

Accordingly, since the busbars having the connection portions with the pair of terminals of the fuse are formed by punching one conductive plate, a material cost for the busbars can be reduced. Further, since the busbars may be formed by a progressive mold, it is not necessary to first form the busbars separately and then arrange the busbars in the same layer of the electrical connection box, thereby reducing the number of operation steps in assembling the electrical connection box. In this respect as well, production costs can be reduced.

According to a preferred embodiment of the invention, the bending step includes forming bent portions to be arranged substantially perpendicular with respect to the base plates.

Preferably, in the folding step the folded portions are arranged substantially parallel with respective side surfaces of the base plates.

Further preferably, the step of forming the slits may be performed together with the punching step and preferably comprises the step of making cuts from the upper ends of the substantially oppositely folded portions.

Accordingly, the number of necessary steps can be further decreased thereby reducing production costs.

Most preferably, in the punching step the base plates are left interconnected by a scrap bridge portion, which may be removed at a later stage.

Accordingly, the busbars can be easily positioned and remain in their correct position or relationship during the mounting of the electrical connection box.

These and other objects, features and advantages of the present invention will become more apparent upon a reading of the following detailed description and accompanying drawings.

BRIEF DESCRIPTION OF THE PREFERRED EMBODIMENT

DETAILED DESCRIPTION OF THE PREFERRED EMBODIMENT

Figure 1:
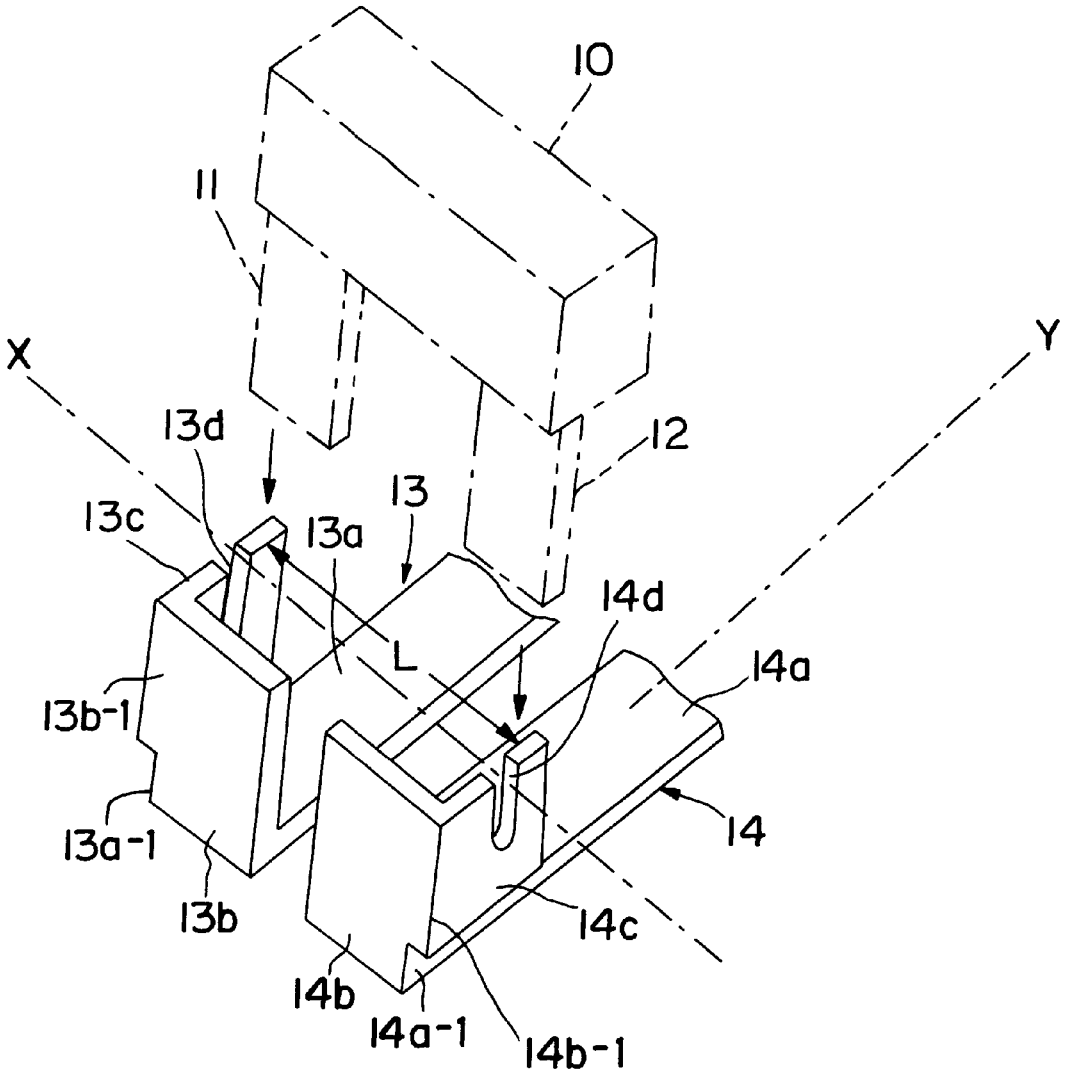
FIG. 1 is a perspective view of one embodiment of the invention.

First and second busbars according to the invention are identified by the numerals 13, 14 in FIG. 1, and are to be connected with a pair of terminals 11, 12 of a fuse 10. The busbars 13 and 14 are arranged substantially in parallel with each other by placing base plates 13*a*, 14*a* thereof substantially adjacent to each other and preferably in coplanar and/or horizontal alignment.

Bent portions 13*b*, 14*b* are provided at the leading ends of the respective base plates 13*a*, 14*a* and are aligned substantially perpendicular to the base plates 13*a*, 14*a*. Folded portions 13*c*, 14*c* extend preferably substantially parallel with side surfaces 13*a*-1, 14*a*-1 of the base plates 13*a*, 14*a* and are provided at distant side edges 13*b*-1, 14*b*-1 of the bent portions 13*b*, 14*b*, which are the edges most distant from the other busbar 1. The folded portions 13*c*, 14*c* are substantially opposed to each other at a predetermined or predeterminable distance L along a direction X that is aligned at an angle different from 0° or 180°, preferably substantially perpendicular to an arrangement direction or extension Y of the base plates 13*a*, 14*a*. Thus the folded portions 13*c*, 14*c* are substantially parallel.

Cuts are made from the upper ends of the folded portions 13*c*, 14*c* to form slits 13*d*, 14*d* into which the terminals 11, 12 are pressed or are pressable. A width W (FIG. 2) of the slits 13*d*, 14*d* is set such that the terminals 11, 12 of the fuse 10 can be pressed or inserted into the slits 13*d*, 14*d* and can be held in contact.

Figure 2:
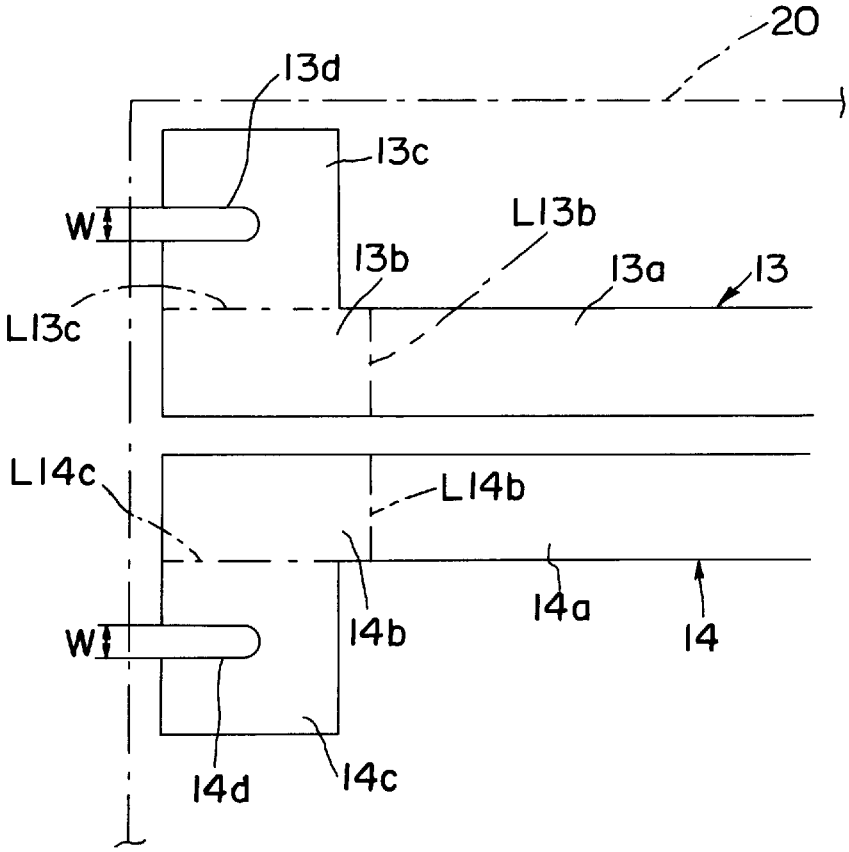
FIG. 2 is a development of busbars according to the embodiment.

The first and second busbars 13, 14 are formed preferably by punching one conductive plate 20 as shown in FIG. 2 and by bending and folding, preferably by a progressive mold. Portions of the busbars 13, 14, such as the base plates 13*a*, 14*a*, may be left interconnected by a scrap bridge portion (not shown) upon completion of the punching step to allow for a precise arrangement of the busbars 13, 14 with respect to each other. The scrap bridge may be separated or removed at a later stage, such as when the busbars 13, 14 are arranged in a casing 21 of the electrical connection box. The bent portions 13*b*, 14*b* preferably are formed by bending the punched conductive plate 20 along first bending lines L13*b*, L14*b*, respectively, thereby arranging the bent portions at an angle different from 0° or 180°, and preferably substantially normal to the base plates 13*a*, 14*a*, respectively. On the other hand, the folded portions 13*c*, 14*c* are formed by bending the bent portions 13*b*, 14*b*, preferably at the distant side edges 13*b*-1, 14*b*-1 thereof, along second bending lines L13*c* and L14*c* respectively. The first bending lines L13*b*, L14*b* and the second bending lines L13*c*, L14*c* are arranged at an angle different from 0° or 180°, and preferably are substantially normal to each other. It should be noted that the steps of bending along the first bending lines L13*b*, L14*b* and along the second bending lines L13*c*, L14*c* may be performed in either order, i.e. first along Ll3*b*, L14*b* and then along L13*c*, L14*c* or the other way round. In other words, the first and second busbars 13, 14 in their developed states are such that the bent portions 13*b*, 14*b* and the folded portions 13*c*, 14*c* extend in substantially opposite directions from the leading ends of the base plates adjacent to and substantially parallel with each other. Accordingly, connection portions with the terminals of the fuse do not interfere each other. Thus, the first and second busbars 13, 14 can be formed from one conductive plate 20.

Figure 3:
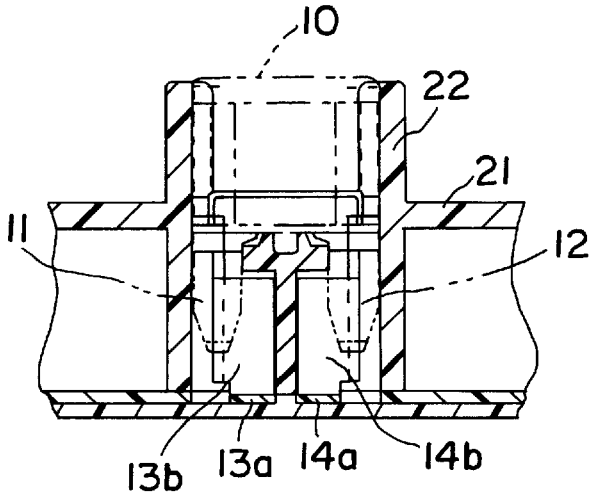
FIG. 3 is a section showing a connected state of the busbars according to the embodiment and a fuse.
Figure 4:
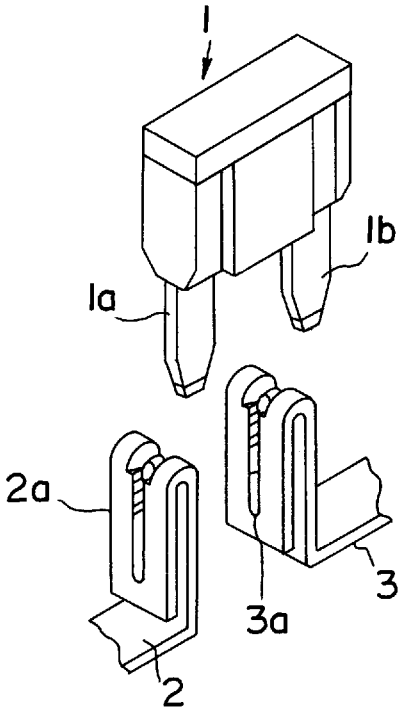
FIG. 4 PRIOR ART
FIG. 4 is a perspective view of a prior art.
Figure 5:
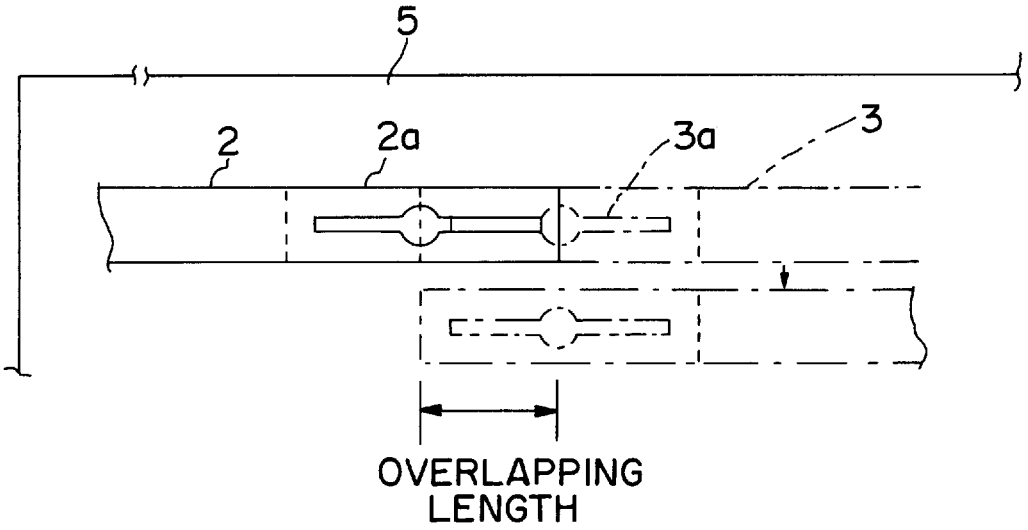
FIG. 5 PRIOR ART
FIG. 5 is a development of busbars according the prior art.
Figure 6:
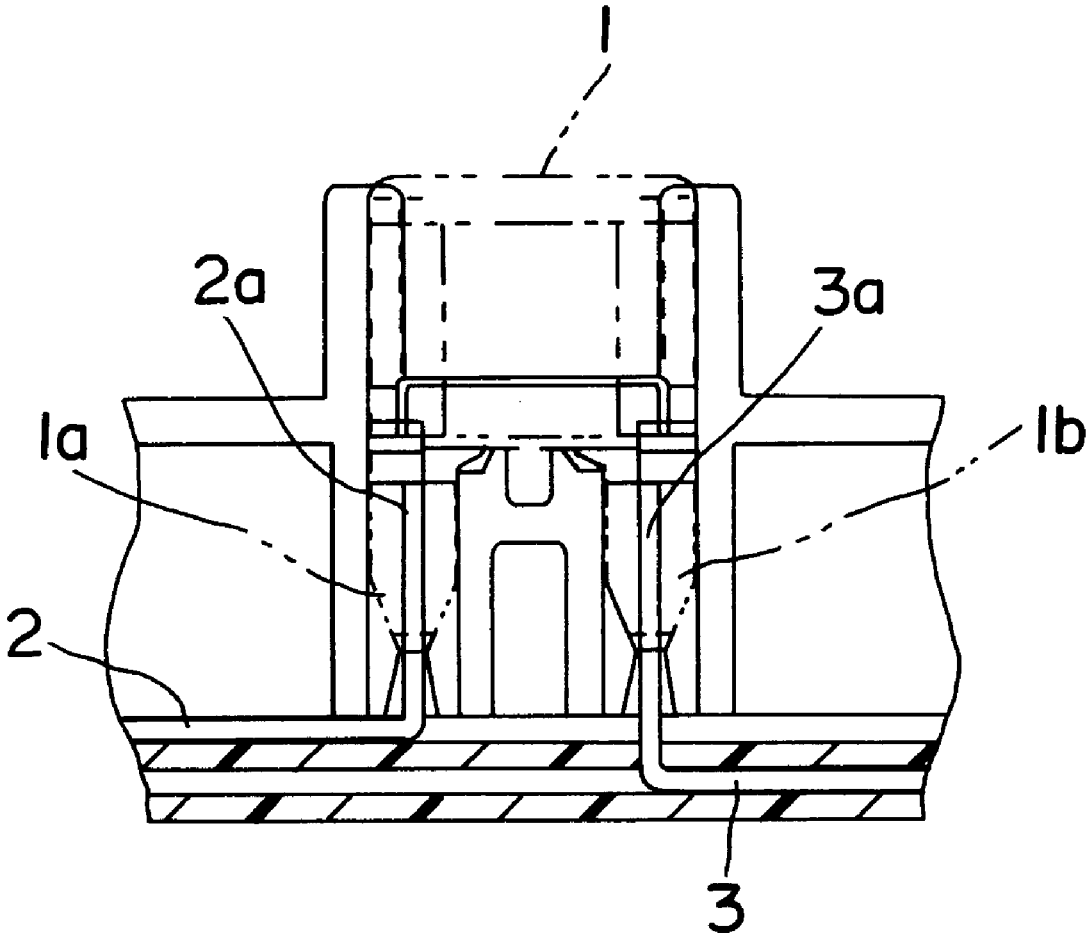
FIG. 6 PRIOR ART
FIG. 6 is a schematic section of another prior art.

The first and second busbars 13, 14 are spaced substantially in parallel by a specified distance substantially in the same layer in the casing 21 of the electrical connection box as shown in FIG. 3. The terminals 11, 12 of the fuse 10 can be fitted into a fuse receptacle 22 provided on the outer surface of the casing 21, and thereby are pressed into the slits 13*d*, 14*d* from above for the connection.

As is clear from the above description, the busbars having the connection portions with the pair of terminals of the fuse are formed by punching one conductive plate. Accordingly, a material cost for the busbars can be reduced. Further, since the busbars can be formed by a progressive mold, it is not necessary to arrange the busbars in the same layer of the electrical connection box, reducing the number of operation steps in assembling the electrical connection box. In this respect as well, production costs can be reduced.

Furthermore, since the busbars to be connected with the pair of terminals of the fuse can be arranged in the same layer, the busbars can be arranged with an improved efficiency and a higher density and the electrical connection box can be made smaller.

What is claimed is:

1. An electrical connection box having a casing and a fuse receptacle for receiving terminals of at least one fuse, busbars being in the casing for engaging the terminals of the fuse received in the fuse receptacle, wherein the busbars each comprise:

a substantially planar base plate having an end, a bent portion provided unitarily at the end of the base plate and being aligned substantially normal to the base plate, such that a first bending line is defined between the base plate and the bent portion, said bent portion having a pair of opposed sides extending substantially normally from the base plate, a folded portion extending unitarily from one said side of the bent portion, such that a second bending line is defined between the bent portion and the folded portion, the folded portion being substantially normal to the bent portion and the second bending line being substantially normal to the first bending line, the folded portion further being normal to the base plate without being directly connected to the base plate, and a slit formed in the folded portion, the slit being aligned substantially parallel to the bent portion and substantially normal to the base plate for connection with one of the terminals of the fuse.

2. An electrical connection box according to claim 1, wherein the fuse comprises a pair of terminals, the fuse terminals being substantially coplanar with one another, the electrical connection box having a pair of said busbars for connection respectively with the terminals of the fuse, the base plates of the respective busbars being substantially parallel with each other, the base plates each having a pair of parallel side edges, one side edge of each base plate facing the base plate of the other busbar in the pair, and the other side edge of each said base plate facing away from the other of said busbars in said pair, and wherein the folded portion of each said busbar extends substantially parallel with the respective side edges of the base plates, the folded portion of each said base plate further being substantially aligned with the side edge of the respective base plate that faces away from the other of said busbars.

3. An electrical connection box according claim 2, wherein the slits comprise cuts formed from ends of the folded portions, the pair of terminals of the fuse being pressable into the slits for electrical connection with the busbars.

4. An electrical connection box according to claim 3, wherein the base plates are substantially coplanar.

5. An electrical connection box according to claim 2, wherein the busbars are formed by punching one conductive plate and are arranged in a single layer in the casing such that the base plates are coplanar.

6. A method for forming terminals on busbars of an electrical connection box for connecting the busbars to at least one pair of terminals of at least one fuse, comprising the steps of:

punching a conductive plate for forming a pair of busbars, each said busbar being substantially L-shaped and having a long leg with a pair of parallel side edges and a short leg with a pair of parallel side edges aligned substantially perpendicular to the parallel side edges of the long leg, the punching of the conductive plate forming a slit in an end of the busbar defining the short leg thereof, the slit being substantially parallel to parallel side edges of long leg;

bending the long leg of the busbar along a first bending line extending perpendicularly between the parallel side edges of the long leg for arranging a bent portion of the long leg and the short leg normal to remaining portions of the long leg thereof;

folding the short leg along a second bending line aligned perpendicular to the first bending line and extending perpendicularly between the parallel side edges of the short leg for forming the short leg into a folded portion substantially normal to both the bent portion of the long leg and to the remaining portions of the long leg.

7. An electrical connection box having a casing and a fuse receptacle for receiving first and second terminals of a fuse, the first and second terminals each being planar and being disposed to lie in a common plane, first and second busbars being disposed in the casing for engaging the respective first and second terminals of the fuse received in the fuse receptacle, the first and second busbars each comprising an elongate base plate, said base plates being in spaced apart substantially parallel coplanar relationship to one another, each said base plate having an end defined by a first bending line, bent portions extending unitarily from the first bending lines of the respective first and second base plates, said bent portions being substantially normal to the respective base plates and in substantially coplanar relationship to one another, the bent portions each having a near side edge in proximity to the other of said bent portions and a second bending line remote from the other of said bent portions, the second bending line being substantially perpendicular to the first bending line, folded portions extending unitarily from the second bending lines, the folded portions being substantially parallel to one another, substantially normal to the respective bent portion and substantially normal to the respective base plate, each said folded portion having a slot formed therein, said slot extending from an edge of the respective folded portion most distant from the base plate and being aligned substantially parallel to the respective bent portion, said slots being aligned with one another and dimensioned to receive the respective terminals of the fuse.

* * * * *